US009385428B2

(12) United States Patent
Toyao et al.

(10) Patent No.: US 9,385,428 B2
(45) Date of Patent: Jul. 5, 2016

(54) METAMATERIAL STRUCTURE

(75) Inventors: Hiroshi Toyao, Tokyo (JP); Noriaki Ando, Tokyo (JP)

(73) Assignee: NEC CORPORATION, Tokyo (JP)

( * ) Notice: Subject to any disclaimer, the term of this patent is extended or adjusted under 35 U.S.C. 154(b) by 732 days.

(21) Appl. No.: 13/634,746

(22) PCT Filed: Mar. 18, 2011

(86) PCT No.: PCT/JP2011/001614

§ 371 (c)(1),
(2), (4) Date: Sep. 13, 2012

(87) PCT Pub. No.: WO2011/114746

PCT Pub. Date: Sep. 22, 2011

(65) Prior Publication Data

US 2013/0002377 A1 Jan. 3, 2013

(30) Foreign Application Priority Data

Mar. 19, 2010 (JP) ..... 2010-065183

(51) Int. Cl.

| | |
|---|---|
| ***H01P 3/08*** | (2006.01) |
| ***H01Q 9/04*** | (2006.01) |
| ***H01Q 13/20*** | (2006.01) |
| ***H01Q 13/28*** | (2006.01) |
| ***H01Q 15/00*** | (2006.01) |

(52) U.S. Cl.

CPC ..... *H01Q 9/0407* (2013.01); *H01P 3/08* (2013.01); *H01Q 13/206* (2013.01); *H01Q 13/28* (2013.01); *H01Q 15/0086* (2013.01)

(58) Field of Classification Search

CPC ..... H01L 23/66

USPC ..... 333/246, 204; 343/905, 904

See application file for complete search history.

(56) References Cited

U.S. PATENT DOCUMENTS 7,557,674 B2 * 7/2009 Kamitsuna ..... 333/104
7,626,476 B2 * 12/2009 Kim et al. ..... 333/238

(Continued)

FOREIGN PATENT DOCUMENTS

JP 2006-157646 * 6/2006
JP 2007-088883 4/2007

(Continued)

OTHER PUBLICATIONS

English Translation of JP 2006-157646—Published on Jun. 15, 2006.*

(Continued)

*Primary Examiner* — Stephen E Jones
(74) *Attorney, Agent, or Firm* — Young & Thompson

(57) ABSTRACT

A second conductor (200) is opposite to a first conductor (100), and is repeatedly arranged. A plurality of vias (400) are provided to each of a plurality of second conductors (200), and provide an inductance component between the first conductor (100) and the second conductor (200). A third conductor (300) is connected to a first one of the second conductors (200) through a via (500), and is opposite to a second one of the second conductors (200) located next to the first one of the second conductors (200), to thereby form a transmission line between the first one of the second conductors and the second one of the second conductors (200). That is, the third conductor (300) functions as a stub together with the second one of the second conductors (200).

20 Claims, 24 Drawing Sheets

(56) References Cited

U.S. PATENT DOCUMENTS

| | | | | |
|---|---|---|---|---|
| 2009/0315648 | A1* | 12/2009 | Toyao | 333/238 |
| 2011/0304516 | A1* | 12/2011 | Ko et al. | 343/722 |

FOREIGN PATENT DOCUMENTS

| | | | |
|---|---|---|---|
| JP | 2008-211676 | | 9/2008 |
| JP | 2008-288770 | | 11/2008 |
| JP | 2008-306495 | | 12/2008 |
| WO | WO 2010/013496 | | 2/2010 |
| WO | WO 2010/076982 | A2 * | 7/2010 |

OTHER PUBLICATIONS

International Search Report, PCT/JP2011/001614, Jun. 21, 2011.

* cited by examiner

METAMATERIAL STRUCTURE

TECHNICAL FIELD

The present invention relates to a structure having characteristics of a metamaterial.

BACKGROUND ART

In recent years, it has become known that the propagation characteristics of electromagnetic waves are able to be controlled by periodically arranging conductor patterns having a specific structure (hereinafter, called a metamaterial). For example, a reduction in size and thickness of an antenna can be achieved by using a metamaterial.

There area so-called right-handed system, left-handed system, and right-handed and left-handed composite system in a metamaterial. Among them, when a metamaterial of a right-handed and left-handed composite system is used as an antenna, increasing the bandwidth of zero-order resonance is preferable because the band of an antenna is widened. In order to increase the bandwidth of zero-order resonance, it is preferable to create a design so as to satisfy so-called "balance conditions" to match the resonance frequency of a series circuit to the resonance frequency of a shunt circuit.

Incidentally, Patent Document 1 discloses a technique in which a plurality of metal platelets are electrically connected to each other through a capacitance element, specifically, a chip capacitance, in order to lower the operating frequency band of the electromagnetic band gap (EBG), which is an example of a metamaterial.

RELATED DOCUMENT

Patent Document

[Patent Document 1] Japanese Unexamined Patent Publication No. 2008-288770

DISCLOSURE OF THE INVENTION

Lowering the frequency of zero-order resonance of a metamaterial while satisfying the balance conditions is important in expanding an application of a metamaterial. In order to lower the frequency of zero-order resonance of the metamaterial while satisfying the balance conditions, it is preferable to lower the resonance frequency of a series circuit corresponding to a shunt circuit. Therefore, even when a method disclosed in Patent Document 1 is used, it is possible to lower the frequency of zero-order resonance of the metamaterial while satisfying the balance conditions. However, in the method disclosed in Patent Document 1, since a chip capacitance is required to be mounted between each of a plurality of metal platelets, there is a problem that manufacturing costs increase.

An object of the invention is to provide a structure capable of lowering the resonance frequency of a series circuit at low cost.

According to the invention, there is provided a structure including: a plurality of second conductors, opposite to the first conductor, which are repeatedly arranged; an inductance element provided at least one for each of the plurality of second conductors, which provide an inductance component between the first conductor and the second conductor; and a third conductor, electrically connected to a first one of the second conductors, which is opposite to a second one of the second conductors located next to the first one of the second conductors.

According to the invention, there is provided a structure including: a first conductor; a second conductor, opposite to the first conductor; and a slit which is repeatedly provided in the first conductor and extends in a direction intersecting the second conductor.

According to the present invention, it is possible to provide a structure capable of lowering the resonance frequency of a series circuit at low cost.

BRIEF DESCRIPTION OF THE DRAWINGS

The above-mentioned objects, other objects, features and advantages will be made clearer with the preferred embodiments described below, and the following accompanying drawings.

DESCRIPTION OF EMBODIMENTS

Figure 1:
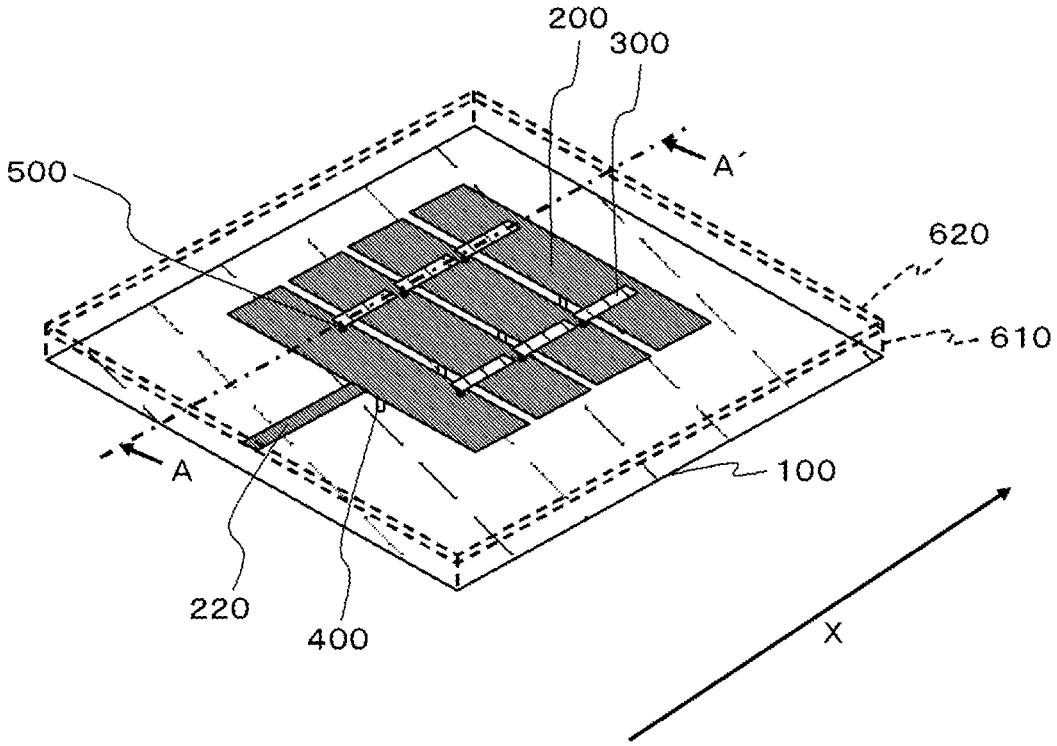
FIG. 1 is a perspective view illustrating a configuration of a structure according to a first embodiment.

Hereinafter, the embodiments of the invention will be described with reference to the accompanying drawings. In all the drawings, like elements are referenced by like reference numerals and signs and descriptions thereof will not be repeated.

Figure 2:
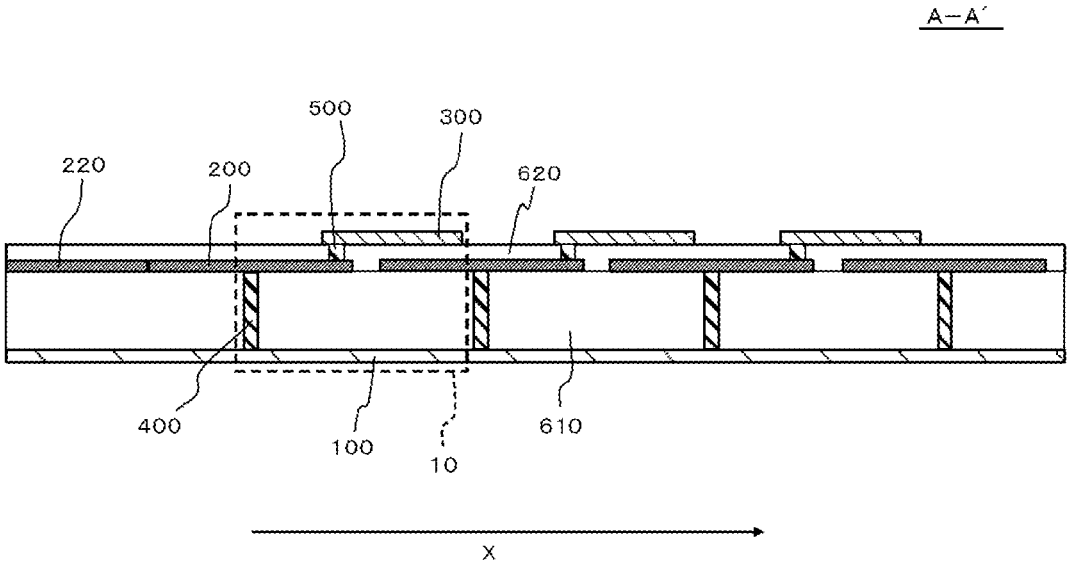
FIG. 2 is a cross-sectional view taken along the line A-A' of FIG. 1.

FIG. 1 is a perspective view illustrating a configuration of a structure according to a first embodiment, and FIG. 2 is a cross-sectional view taken along the line A-A' of FIG. 1. In FIG. 2, a via 400 described later is shown for convenience of description. This structure includes a first conductor 100, a plurality of second conductors 200, a plurality of vias (inductance elements) 400, and a third conductor 300. A plurality of second conductors 200 are opposite to the first conductor 100, and are repeatedly, for example, periodically arranged. A plurality of vias 400 are provided at least one for each of a plurality of second conductors 200, and provide an inductance component between the first conductor 100 and the second conductor 200. In the embodiment, the via 400 is configured such that one end thereof is connected to the first conductor 100, and the other end thereof is connected to the second conductor 200. The third conductor 300 is connected to a first one of the second conductors 200 through a via 500, and is opposite to a second one of the second conductors 200 located next to the first one of the second conductors 200, to thereby form a transmission line between the first one of the second conductors and the second one of the second conductors 200. In the embodiment, the third conductor 300 functions as a stub together with the second one of the second conductors 200. That is, the third conductor 300 forms a microstrip line using the second one of the second conductors 200 as a return path. In the embodiment, three or more second conductors 200 are provided, and the third conductor 300 is provided between at least a set of second conductors 200 located next to each other. In addition, the second conductor 200 which is close to a power feed conductor 220, described later, out of the two second conductors 200 located next to each other is set as the first one of the second conductors 200. Hereinafter, a description will be made in detail.

The first conductor 100 extends in a sheet shape, and is, for example, a metal film such as a Cu film. A first insulating layer 610 is provided on the first conductor 100. The second conductor 200 is, for example, a metal film such as a Cu film, and is repeatedly provided on the first insulating layer 610 along a first direction (X direction in the drawing). A plurality of vias 400 pass through the first insulating layer 610. In FIG. 2, the via 400 is connected to the central portion of the second conductor 200 in the X direction in the drawing, but a place in which the via 400 connected to the second conductor 200 is not limited thereto.

A second insulating layer 620 is provided on a plurality of second conductors 200 and the first insulating layer 610. The third conductor 300 is, for example, a metal film such as a Cu film, and is repeated, for example, periodically provided on the second insulating layer 620. In the embodiment, the third conductor 300 is located at the opposite side to the first conductor 100 through the second conductor 200. The third conductor 300 is configured such that one end thereof is electrically connected to the first one of the second conductors 200, and the other end thereof extends to a region overlapping the second one of the second conductors 200. The other end of the third conductor 300 is formed of an open end with respect to the second one of the second conductors, and thus the third conductor 300 functions as an open stub.

The via 500 passes through the second insulating layer 620, and is configured such that one end thereof is connected to the second conductor 200 and the other end thereof is connected to one end of the third conductor 300. In FIG. 2, the via 500 is connected to the second conductor 200 at the end of the second conductor 200, that is, a place which does not overlap the via 400, in the X direction in the drawing.

Meanwhile, as shown in FIG. 1, in the embodiment, two sets of vias 500 and third conductors 300 are formed with respect to a set of second conductors, the number of vias 500 and third conductors 300 is not limited thereto. In addition, the third conductor 300 is, for example, a conductor pattern extending linearly, but is not limited thereto.

As stated above, the first conductor 100 is formed in a first conductor layer, a plurality of second conductors 200 are formed in a second conductor layer located on the first conductor layer, and a plurality of third conductors 300 are formed in a third conductor layer located on the second conductor layer.

In addition, the power feed conductor 220 is formed in the second conductor layer. The power feed conductor 220 is electrically connected to the second conductor 200 located at one end of the array of the second conductor 200. The power feed conductor 220 may be directly connected to the second conductor 200, and may be capacitively coupled thereto. The power feed conductor 220 is opposite to the first conductor 100, and thus forms a power feed line together with the first conductor 100. For this reason, the structure according to the embodiment functions as a resonant antenna (zero-order resonant antenna). Meanwhile, when the wavelength of a signal which is input to the structure is set to $\lambda$, the length of the portion opposed to the second one of the second conductors 200 in the third conductor 300 is equal to $\lambda/4$. However, when the structure is used as a left-handed system metamaterial, the length may be equal to or less than $\lambda/4$.

In the structure according to the embodiment, a unit cell 10 is repeatedly, for example, periodically arranged. The unit cell 10 is composed of the first conductor 100, the via 400, half of the first one of the second conductors 200, half of the second one of the second conductors 200, the via 500, and the third conductor 300. The unit cell 10 is repeatedly arranged, and thus portions other than the power feed line of the structure function as a metamaterial.

In addition, when the unit cells 10 are arranged repeatedly, it is preferable that the gap between the same vias (center-to-center distance) is within ½ of wavelength $\lambda$ of electromagnetic waves assumed as noise, in the unit cells 10 adjacent to each other. In addition "repeatedly" also includes a case where a portion of the configuration is missing in any of the unit cells 10. In addition, when the unit cells 10 have a two-dimensional array, "repeatedly" also includes a case where the unit cells 10 is partially missing. In addition, "periodic" also includes a case where a portion of the components is out of alignment in some unit cells 10, or a case where the arrangement of some unit cells 10 themselves is out of alignment. That is, even when periodicity in a strict sense collapses, the characteristics as a metamaterial can be obtained when the unit cells 10 are repeatedly arranged, and thus some degree of defects are allowed in the "periodicity". Meanwhile, it is considered that factors for which these defects are caused include a case of passing the interconnects or the vias between the unit cells 10, a case where the unit cells 10 cannot be arranged due to the existing vias or patterns when a metamaterial structure is added to the existing interconnect layout, manufacturing errors, a case where the existing vias or patterns are used as a portion of the unit cell 10, and the like.

Figure 3:
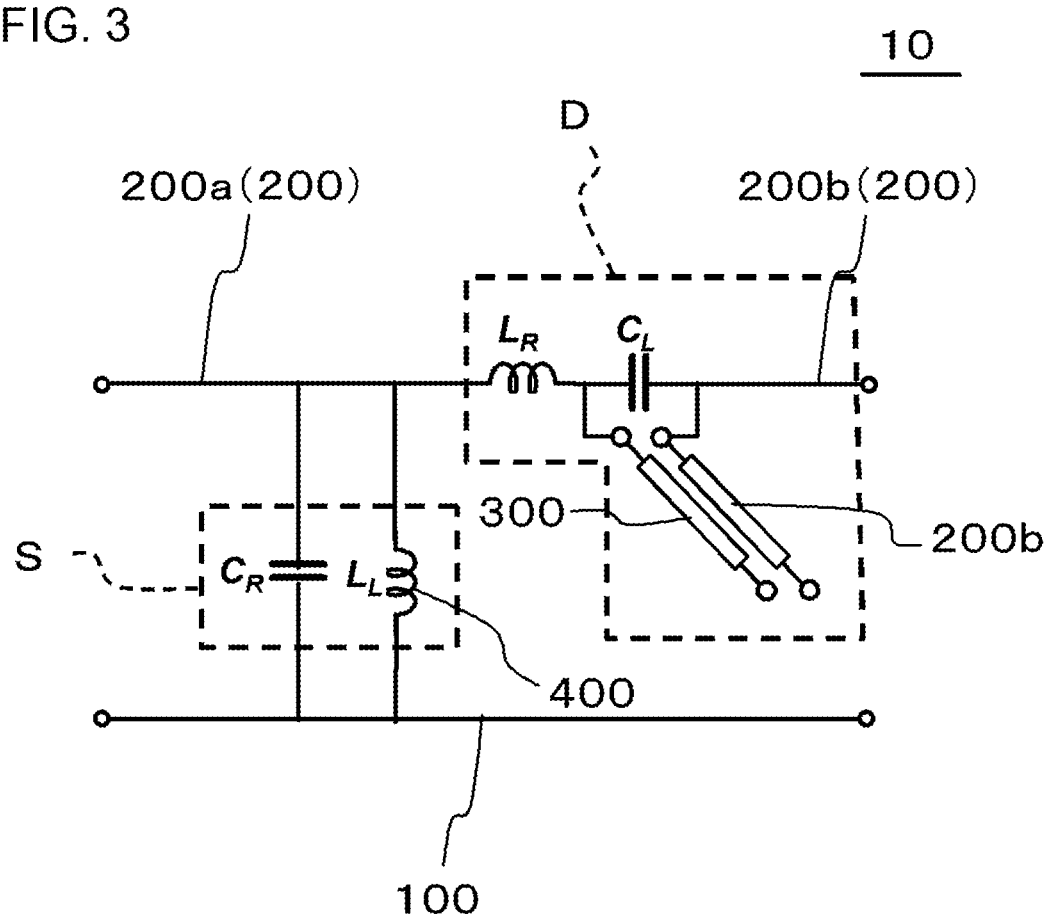
FIG. 3 is an equivalent circuit diagram of a unit cell shown in FIG. 2.

FIG. 3 is an equivalent circuit diagram of the unit cell 10 shown in FIG. 2. The first conductor 100 and the second conductor 200 are opposite to each other, and thus a capacitance $C_R$ is formed therebetween. In addition, the first conductor 100 and the second conductor 200 are connected to each other through the via 400, and thus an inductance $L_L$ caused by the via 400 is formed between the first conductor 100 and the second conductor 200. For this reason, a shunt circuit S having the capacitance $C_R$ and the inductance $L_L$ is formed between the first conductor 100 and the second conductor 200.

On the other hand, the ends of a first one of second conductors 200*a* and a second one of second conductors 200*b* are opposite to each other, and thus a capacitance $C_L$ is formed at this portion. In addition, the first one of the second conductors 200*a* has an inductance $L_R$. For this reason, a series circuit D having the capacitance $C_L$ and the inductance $L_R$ is formed between the first one of the second conductors 200*a* and the second one of the second conductors 200*b*.

Since the third conductor 300 forms an open stub using the second one of the second conductors 200*b* as a return path, the input impedance of the open stub is added to the series circuit D.

Next, operations and effects of the embodiment will be described. In the embodiment, an open stub is formed between the third conductor 300 and the second one of the second conductors 200*b*. When the length of the open stub is shorter than ¼ of a wavelength at an operating frequency, the input impedance of the open stub becomes capacitive, and thus a large capacity can be provided between the first one of the second conductors 200*a* and the second one of the second conductors 200*b*. Therefore, in the frequency range satisfying the above-mentioned conditions, the embodiment operates as a left-handed system metamaterial, and can be used as, for example, a small-sized resonant antenna making use of −1-order and −2-order resonances, or a leaky wave antenna making use of a negative refractive index.

In addition, when the length of the open stub is close to ¼ of a wavelength at an operating frequency, the input impedance of the open stub becomes equal to an LC series resonance state. Particularly, when the inductance $L_R$ is small and thus negligible, the resonance frequency of the series circuit D becomes nearly equal to the resonance frequency of the open stub, and thus the resonance frequency of the series circuit D can be easily controlled by changing the length of the open stub. Therefore, in the embodiment, it is possible to easily satisfy "balance conditions" that is to match the resonance frequency of the series circuit D to the resonance frequency of the shunt circuit S, and to improve the characteristics of a resonant antenna.

Further, in the embodiment, since the resonance frequency can be lowered by increasing the length of the open stub, it is possible to achieve a lowering in frequency at lower cost than in a case where discrete components such as a chip inductor are mounted. Therefore, in the embodiment, it is possible to lower the zero-order resonance frequency easily and at low cost while satisfying the balance conditions. As a result, in the embodiment, a zero-order resonant antenna operating at a lower band can be provided at low cost.

Figure 4:
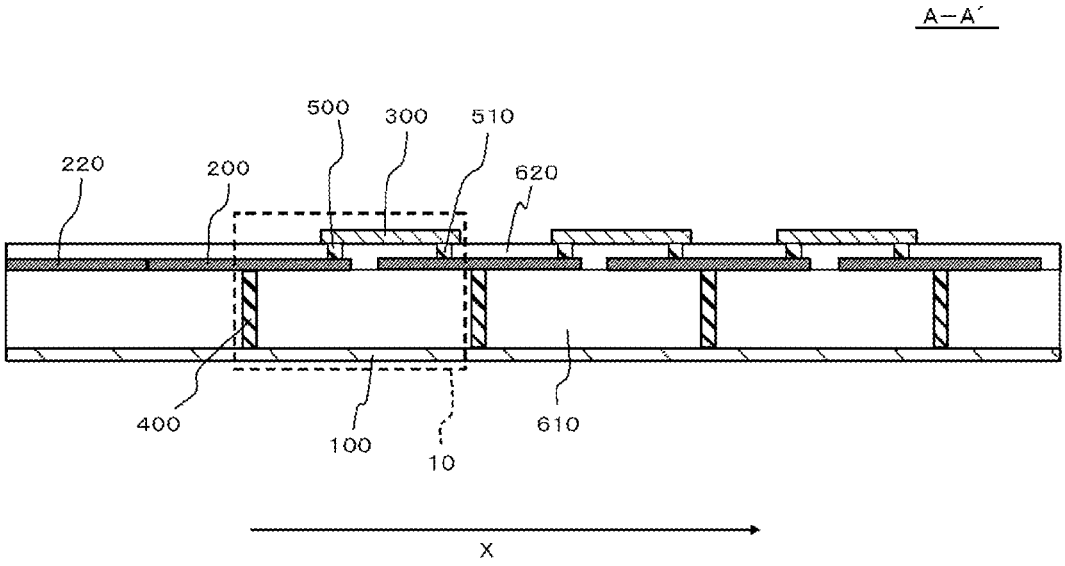
FIG. 4 is a cross-sectional view illustrating a configuration of a structure according to a second embodiment.

FIG. 4 is a cross-sectional view illustrating a configuration of a structure according to a second embodiment, and is equivalent to FIG. 2 in the first embodiment. The structure according to the embodiment has the same configuration as the structure according to the first embodiment, except that a plurality of vias 510 are included.

The via 510 passes through the second insulating layer 620, and connects the other end of the third conductor 300 to the second one of the second conductors 200. The via 510 is provided, and thus the stub formed by the third conductor 300 and the second one of the second conductors 200 functions as a short stub. Meanwhile, when the wavelength of a signal which is input to the structure is set to λ, the length of the portion opposed to the second one of the second conductors 200 in the third conductor 300 is equal to λ/2. However, when the structure is used as a left-handed system metamaterial, the length may be equal to or more than λ/4 and equal to or less than λ/2. That is, when the length of the short stub is equal to or more than ¼ of a wavelength and equal to or less than ½ of a wavelength at an operating frequency, the input impedance of the short stub becomes capacitive, a large capacity can be provided between the first one of the second conductors 200*a* and the second one of the second conductors 200*b*. Therefore, in the frequency range satisfying the above-mentioned conditions, the embodiment operates as a left-handed system metamaterial, and can be used, for example, a small-sized resonant antenna making use of −1-order and −2-order resonances, or a leaky wave antenna making use of a negative refractive index.

In addition, when the length of the short stub is close to ½ of a wavelength at an operating frequency, the input impedance of the short stub becomes equal to an LC series resonance state. In particular, when the inductance $L_R$ is small and thus negligible, the resonance frequency of the series circuit D becomes nearly equal to the resonance frequency of the short stub, and thus the resonance frequency of the series circuit D can be easily controlled by changing the length of the short stub. Therefore, in the embodiment, the same effect as that of the first embodiment can also be obtained.

Figure 5:
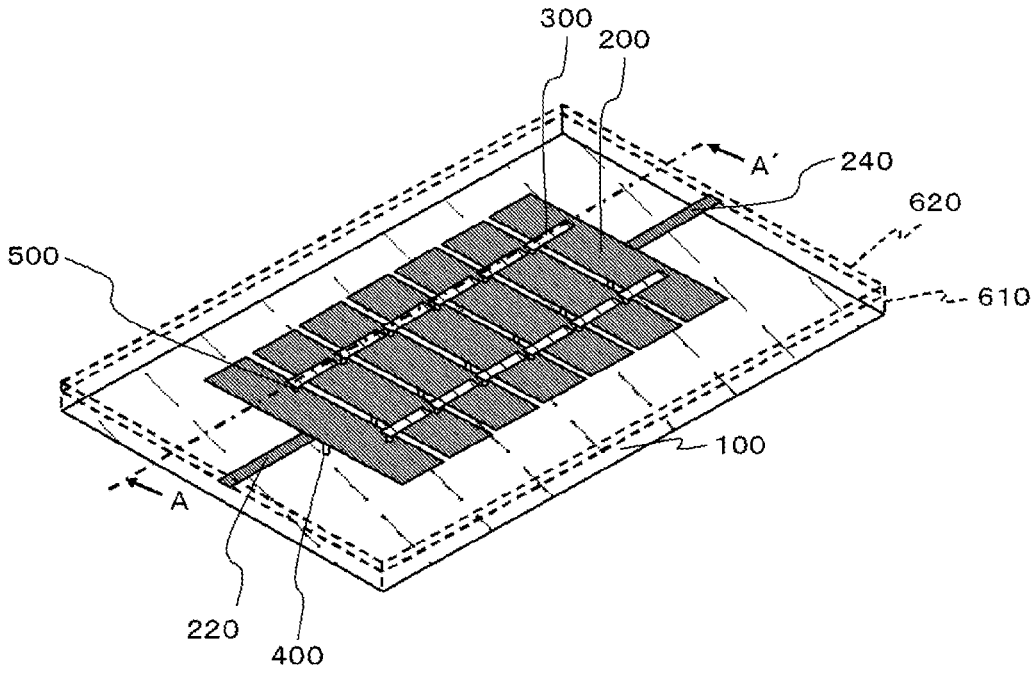
FIG. 5 is a perspective view illustrating a configuration of a structure according to a third embodiment.
Figure 6:
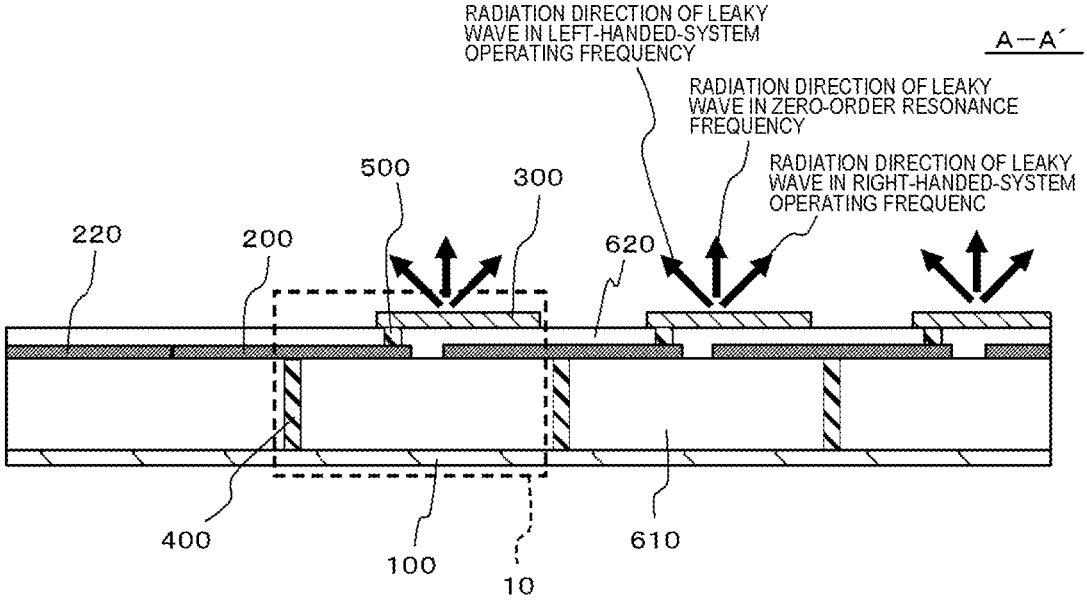
FIG. 6 is a cross-sectional view taken along the line A-A' of FIG. 5.

FIG. 5 is a perspective view illustrating a configuration of a structure according to a third embodiment, and FIG. 6 is a cross-sectional view taken along the line A-A' of FIG. 5. This structure has the same configuration as the structure according to the first or second embodiment, except that a power feed conductor 240 is included. Meanwhile, FIG. 6 shows a similar case to that in the first embodiment.

The power feed conductor 240 is formed in the second conductor layer, and is electrically connected to the second conductor 200 located at the other end of the array of the second conductor 200. That is, a plurality of second conductors 200 are located between the power feed conductor 220 and the power feed conductor 240. The power feed conductor 220 may be directly connected to the second conductor 200, and may be capacitively coupled thereto.

In such a configuration, the structure shown in FIGS. 5 and 6 functions a right-handed and left-handed composite line, and may be used as, for example, a leaky wave antenna. FIG. 6 is a diagram illustrating radiation directions of leaky waves when power is input from the power feed conductor 220. Since the structure in FIG. 6 operates as a left-handed system metamaterial at a frequency lower than the zero-order resonance frequency and the value of the refractive index of the structure is negative, leaky waves are refracted and radiated backward with respect to the traveling direction of power. On the other hand, since the structure operates as a right-handed system metamaterial at a frequency higher than the zero-order resonance frequency and the value of the refractive index of the structure is positive, leaky waves are refracted and radiated forward with respect to the traveling direction of power. In addition, leaky waves are refracted and radiated in the direction perpendicular to the structure at the zero-order resonance frequency. Therefore, the radiation direction of leaky waves can be change from the forward direction to the backward direction by changing the operating frequency.

In the embodiment, a leaky wave antenna capable of performing scanning over a wide angle in the radiation direction by changing the frequency can be provided at low cost. In addition, in the embodiment, the same effect as that of the first embodiment can also be obtained.

Figure 7:
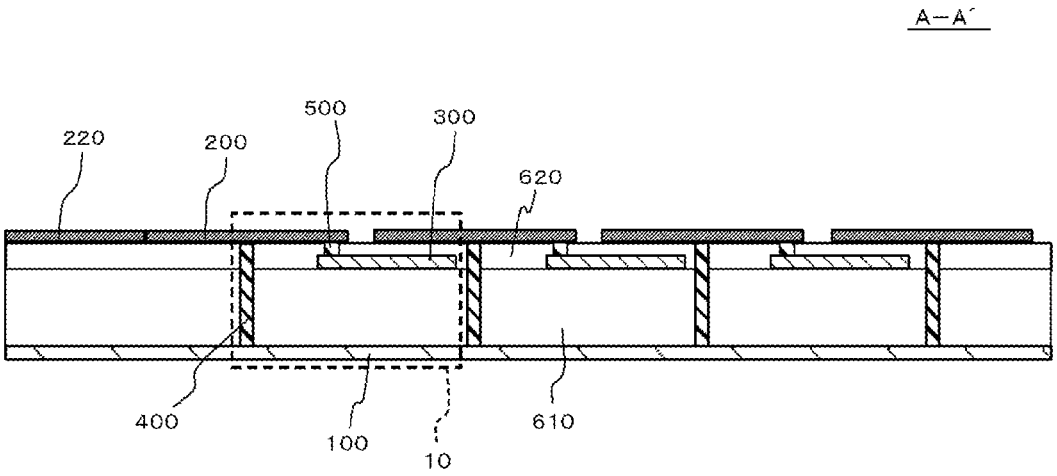
FIG. 7 is a cross-sectional view illustrating a configuration of a structure according to a fourth embodiment.

FIG. 7 is a cross-sectional view illustrating a configuration of a structure according to a fourth embodiment, and corresponds to FIG. 2 in the first embodiment. The structure according to the embodiment has the same configuration as the structure according to the first embodiment or second embodiment, except that a second conductive layer is located on a third conductive layer. Meanwhile, FIG. 7 shows a similar case to that in the first embodiment.

In the embodiment, the power feed conductor 220 and a plurality of second conductors 200 constituting the second conductive layer are formed on the second insulating layer 620. The third conductor 300 constituting the third conductive layer is formed on the first insulating layer 610. That is, the third conductor 300 is located between the first conductor 100 and the second conductor 200. In addition, the via 400 passes through the first insulating layer 610 and the second insulating layer 620.

In the embodiment, the same effect as that of the first embodiment can also be obtained. In addition, according to the embodiment, since the third conductor 300 is formed in the inside of the insulating layer, the effective dielectric constant of the stub is higher than in a case where it is formed on the surface. For this reason, it is possible to shorten the stub length by a wavelength shortening effect, and to reduce the size of the structure.

Figure 8:
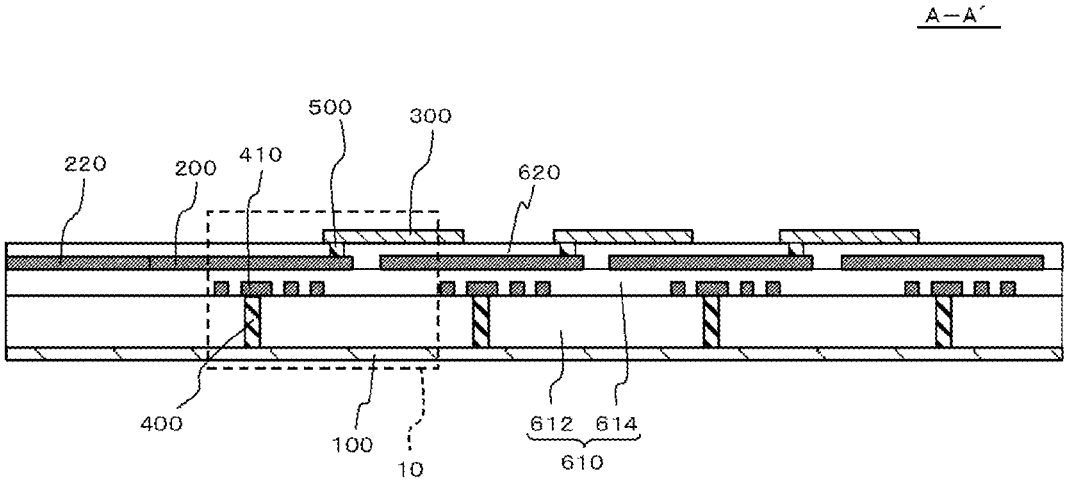
FIG. 8 is a cross-sectional view illustrating a configuration of a structure according to a fifth embodiment.

FIG. 8 is a cross-sectional view illustrating a configuration of a structure according to a fifth embodiment, and corresponds to FIG. 2 in the first embodiment. The structure according to the embodiment has the same configuration as the structure according to the first embodiment or second embodiment, except for the following points. Meanwhile, FIG. 7 shows a similar case to that in the first embodiment.

First, the first insulating layer 610 is a structure in which an insulating layer 612 and an insulating layer 614 are laminated in this order, and the power feed conductor 220 and a plurality of second conductors 200 are formed on the insulating layer 614. In addition, the via 400 passes through the insulating layer 612, but does not reach the insulating layer 614.

A fourth conductor 410 is formed on the insulating layer 612. The fourth conductor 410 is an interconnect-shaped conductor pattern. The fourth conductor 410 is configured such that one end thereof is connected to the other end of the via 400, and the other end thereof forms an open end. For this reason, in the embodiment, the via 400 is not electrically connected to the second conductor 200 directly.

Figure 9:
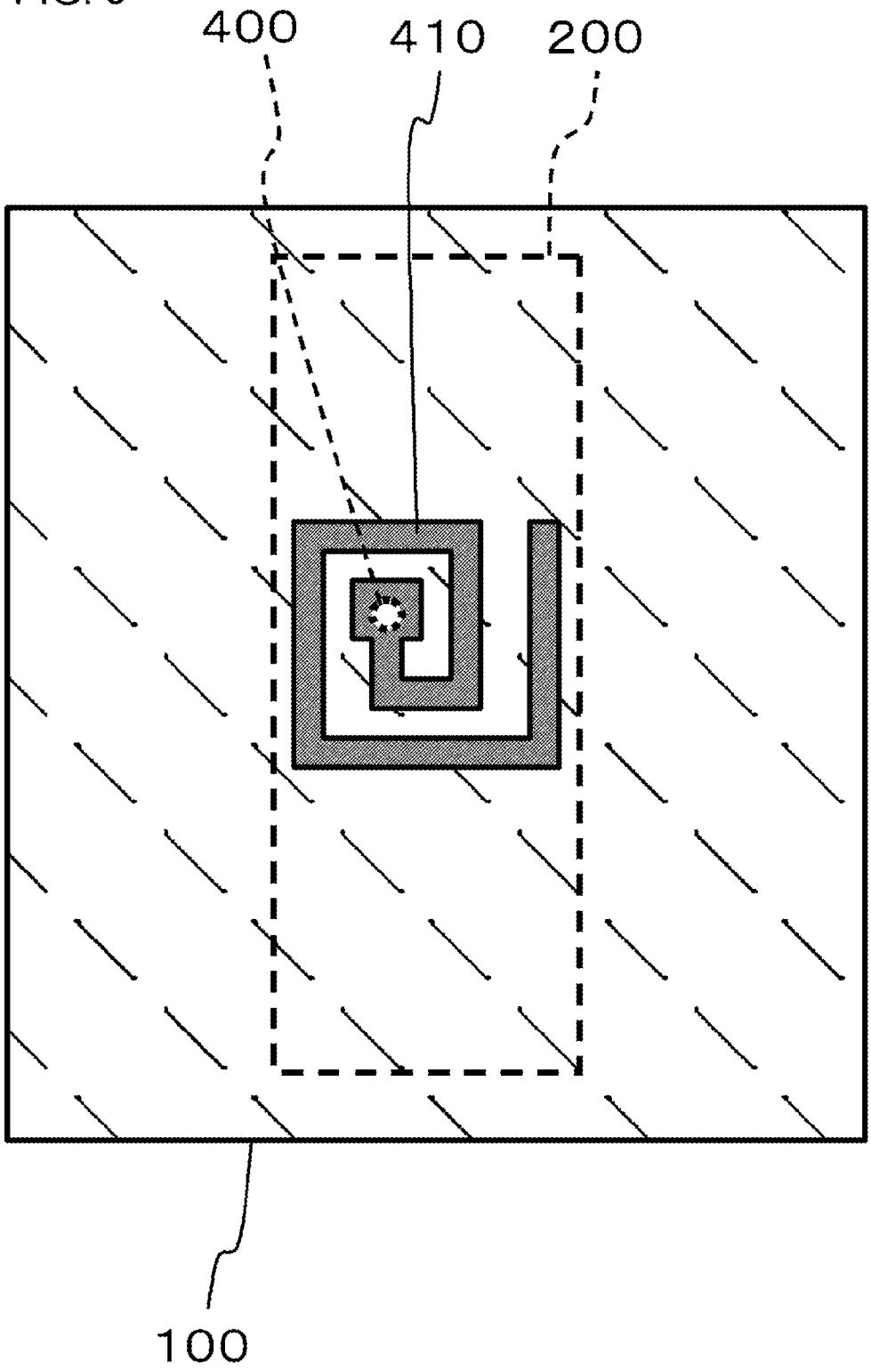
FIG. 9 is a plan view illustrating a pattern of a fourth conductor.

FIG. 9 is a plan view illustrating a pattern of the fourth conductor 410. In the example shown in the drawing, the fourth conductor 410 extends in a spiral shape. In the fourth conductor 410, the end located at the spiral center is connected to the via 400. The spiral that the fourth conductor 410 forms is configured such that the entirety thereof is opposite to the second conductor 200, and it forms an open stub using the second conductor 200 as a return path.

Figure 10:
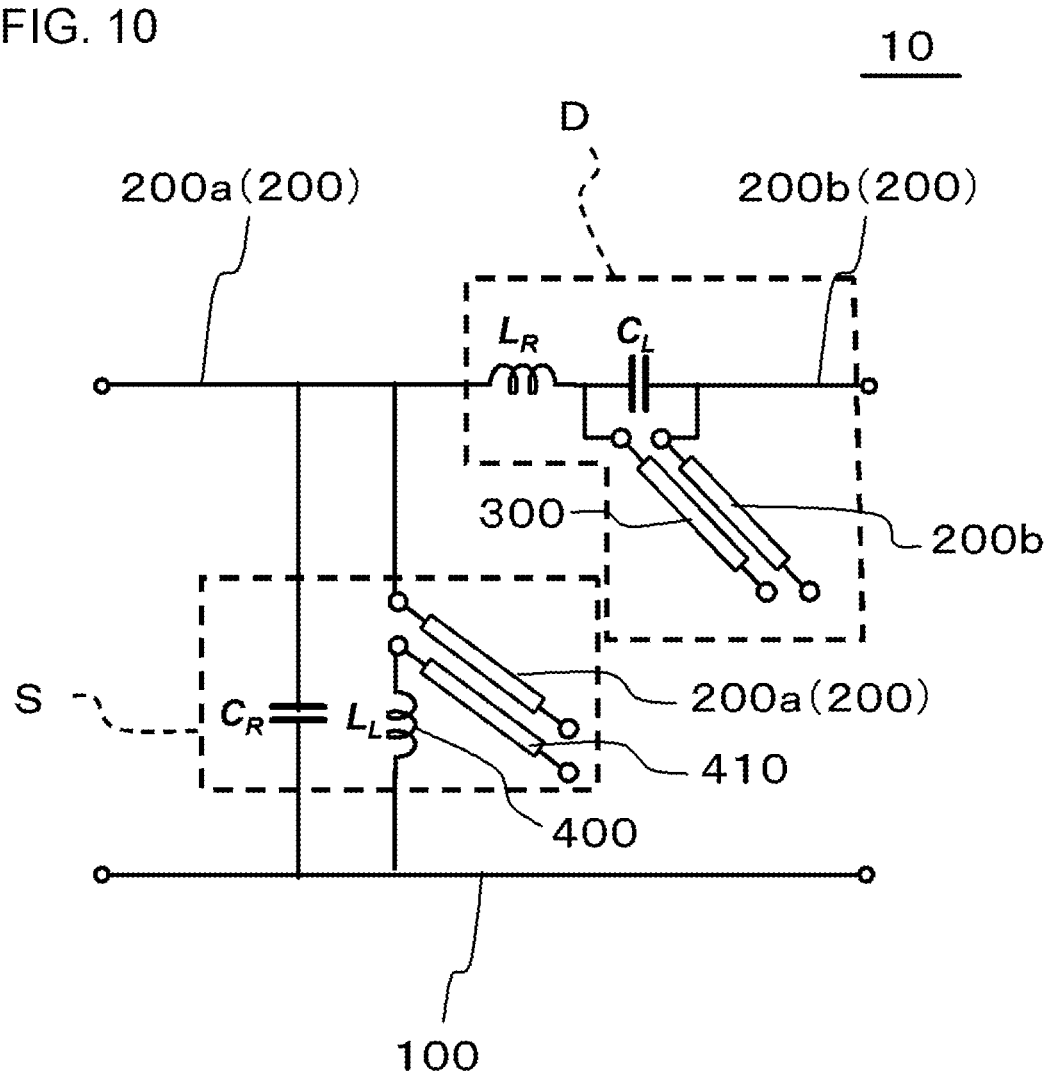
FIG. 10 is an equivalent circuit diagram of a unit cell in the structure shown in FIG. 8.

FIG. 10 is an equivalent circuit diagram of the unit cell 10 in the structure shown in FIG. 8. The equivalent circuit shown in the drawing has the same configuration as the equivalent circuit shown in FIG. 3 in the first embodiment, except that the shunt circuit S has an open stub composed of the fourth conductor 410 and the first one of the second conductors 200*a*.

In the embodiment, the same effect as that of the first embodiment can also be obtained. In addition, since the shunt circuit S has an open stub, the resonance frequency of the shunt circuit S can be easily lowered by increasing the stub length.

Figure 11:
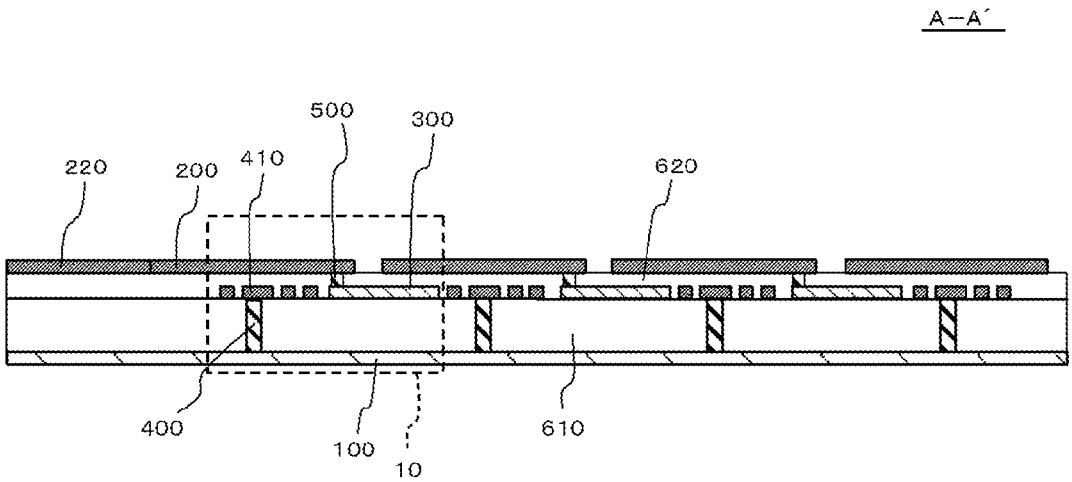
FIG. 11 is a cross-sectional view illustrating a configuration of a structure according to a sixth embodiment.

FIG. 11 is a cross-sectional view illustrating a configuration of a structure according to a sixth embodiment, and corresponds to FIG. 8 in the fifth embodiment. The structure according to the embodiment has the same configuration as the structure according to the fifth embodiment, except for the following points.

First, the power feed conductor 220 and a plurality of second conductors 200 constituting the second conductive layer is formed on the second insulating layer 620. The third conductor 300 constituting the third conductive layer is formed on the first insulating layer 610.

In addition, the fourth conductor 410 is formed on the first insulating layer 610, that is, on the same layer as the third conductor 300. For this reason, the via 400 passes through only the first insulating layer 610. Meanwhile, the first insulating layer 610 is not required to have a two-layer structure, unlike in the fifth embodiment.

In the embodiment, the same effect as that of the fifth embodiment can also be obtained. In addition, since the fourth conductor 410 can be formed on the same layer as the third conductor 300, it is possible to reduce the number of layers required for the structure. In addition, since the third conductor 300 is formed in the inside of the insulating layer, the effective dielectric constant of the stub is higher than in a case where the third conductor 300 is formed on the surface. For this reason, it is possible to shorten the stub length by a wavelength shortening effect, and to reduce the size of the structure.

Figure 12:
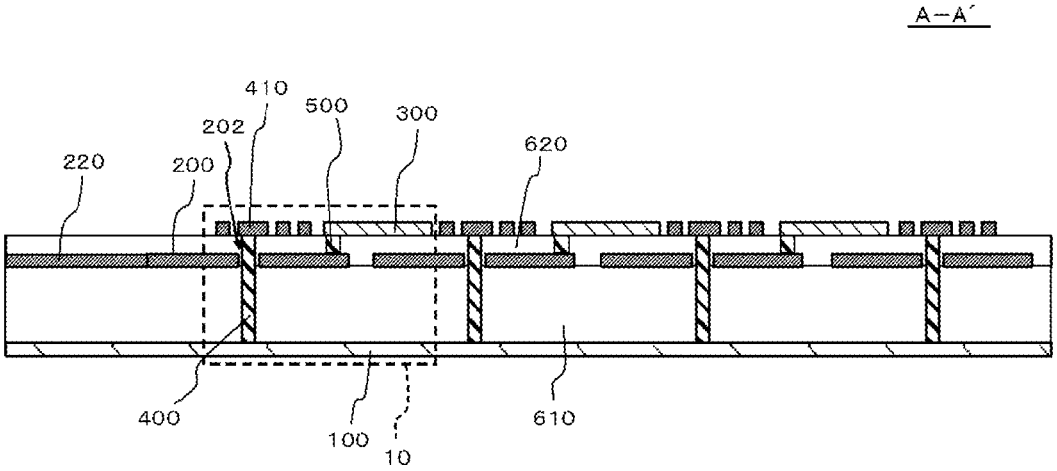
FIG. 12 is a cross-sectional view illustrating a configuration of a structure according to a seventh embodiment.

FIG. 12 is a cross-sectional view illustrating a configuration of a structure according to a seventh embodiment, and corresponds to FIG. 8 in the fifth embodiment. In the structure according to the embodiment has the same configuration as the structure according to the fifth embodiment, except for the following points.

First, the fourth conductor 410 is formed on the second insulating layer 620, that is, on the same layer as the third conductor. In addition, the second conductor 200 has an opening 202, and the via 400 passes through the first insulating layer 610 and the second insulating layer 620 through the opening 202. For this reason, the via 400 can be connected to the fourth conductor 410 without electrical conduction with the second conductor 200. Meanwhile, the first insulating layer 610 is not required to have a two-layer structure, unlike in the fifth embodiment.

In the embodiment, the same effect as that of the fifth embodiment can also be obtained. In addition, since the fourth conductor 410 can be formed on the same layer as the third conductor 300, it is possible to reduce the number of layers required for the structure. In addition, according to the embodiment, since the third conductor 300 and the fourth conductor 410 are formed on the surface, a dielectric loss in the stub is reduced further than in a case where they are formed in an inner layer. For this reason, it is possible to improve radiation efficiency by reducing a loss of power.

Figure 13:
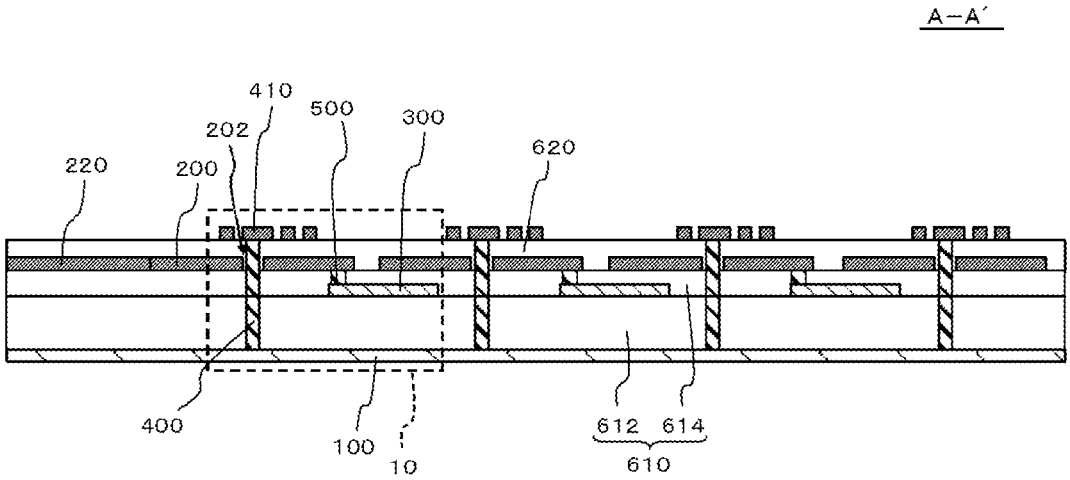
FIG. 13 is a cross-sectional view illustrating a configuration of a structure according to an eighth embodiment.

FIG. 13 is a cross-sectional view illustrating a configuration of a structure according to an eighth embodiment, and corresponds to FIG. 8 in the fifth embodiment. The structure according to the embodiment has the same configuration as the structure according to the fifth embodiment, except for the following points.

First, the fourth conductor 410 is formed on the second insulating layer 620, while the third conductor 300 is formed on the insulating layer 612. The via 500 is buried in the insulating layer 612.

In addition, the second conductor 200 has the opening 202, and the via 400 passes through the first insulating layer 610 and the second insulating layer 620 through the opening 202. For this reason, the via 400 can be connected to the fourth conductor 410 without electrical conduction with the second conductor 200.

In the embodiment, the same effect as that of the fifth embodiment can also be obtained. In addition, since the third conductor 300 is formed in the inside of an insulating layer, the effective dielectric constant of the stub is higher than in a case where the third conductor 300 is formed on the surface. For this reason, it is possible to shorten the stub length by a wavelength shortening effect, and to reduce the size of the structure.

Figure 14:
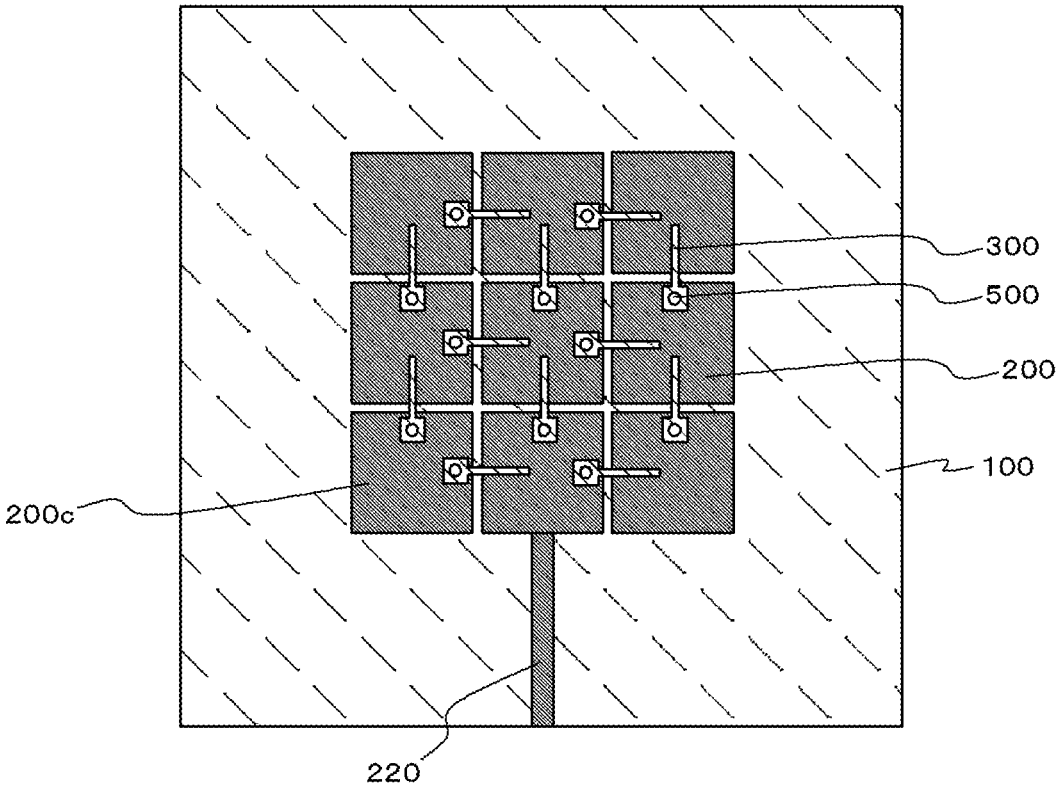
FIG. 14 is a plan view illustrating a configuration of a structure according to a ninth embodiment.

FIG. 14 is a plan view illustrating a configuration of a structure according to a ninth embodiment. The structure according to the embodiment has the same configuration as the structure according to any of the first to eighth embodiments, except that the second conductor 200 has a two-dimensional array.

In the embodiment, one of the second conductors 200 located at the end of the array of a plurality of second conductors 200, specifically, the second conductor 200 located at a corner closest to the power feed conductor 220 is set as a reference second conductor 200*c*. The conductor close to the reference second conductor 200*c* out of the second conductors 200 located next to each other is set as a first one of the second conductors 200.

More specifically, the second conductor 200 may be adjacent to each other in the longitudinal direction in the drawing (first direction), or may be adjacent to each other in the transverse direction in the drawing (second direction). In the second conductors 200 adjacent to each other in the longitudinal direction in the drawing, the second conductor 200 located at the lower side in the drawing becomes the first one of the second conductors 200. In the second conductors 200 adjacent to each other in the transverse direction in the drawing, the second conductor 200 located at the left side in the drawing becomes the first one of the second conductors 200. However, the arrays of the first one of the second conductors 200 and the second one of the second conductors 200 are not limited to such an example, and for example, there is no problem even when the directions of the stubs located next to each other are reverse.

In the embodiment, the same effects as those of the first to eighth embodiments can also be obtained.

Figure 15:
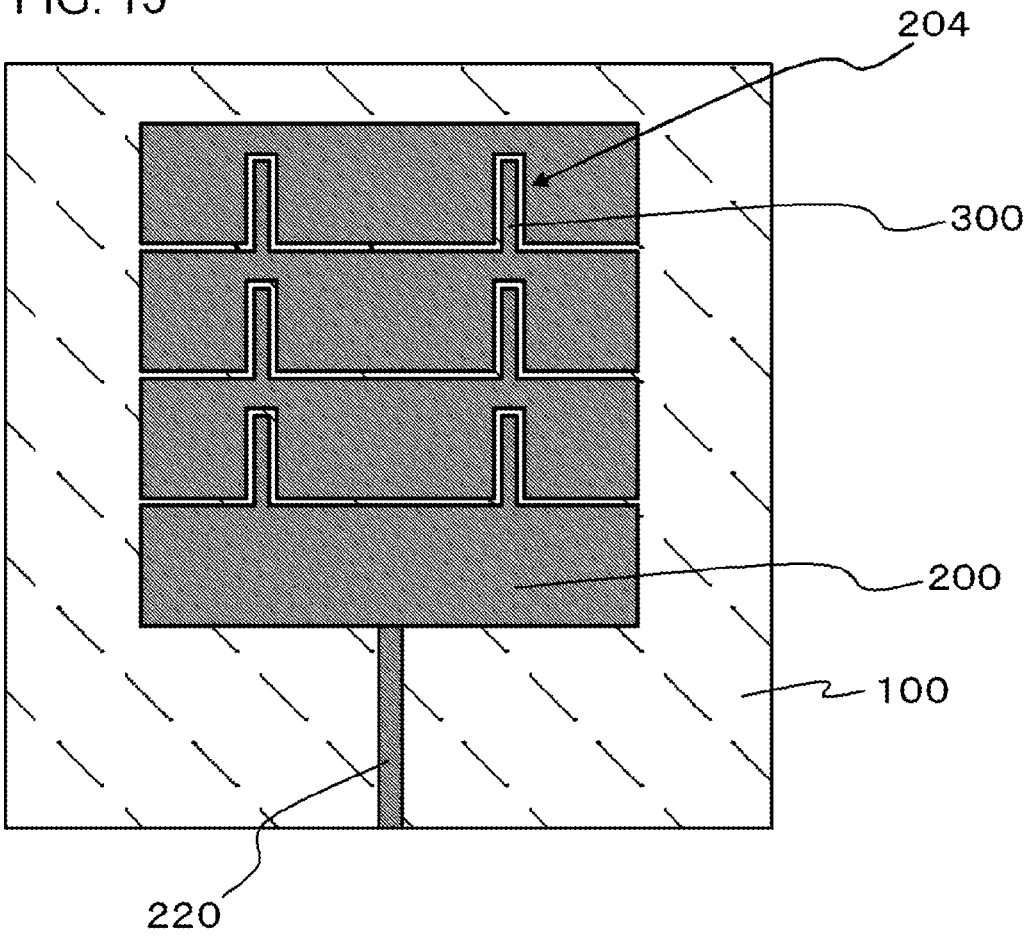
FIG. 15 is a plan view illustrating a configuration of a structure according a tenth embodiment.

FIG. 15 is a plan view illustrating a configuration of a structure according to a tenth embodiment. The structure according to the embodiment has the same configuration as the structure according to the first embodiment, except that the third conductor 300 is formed on the same layer as the second conductor 200, and the via 500 is not included.

Specifically, a plurality of second conductors 200 have concave portions 204 except for the second conductor 200 connected to the power feed conductor 220. The second conductor 200 is rectangular in shape, and the concave portion 204 is formed at the side which is close to the power feed conductor 220 in the second conductor 200. The third conductor 300 is formed integrally with the second conductor 200, and extends from the side which is far from the power feed conductor 220 in the second conductor 200, to the inner side of the concave portion 204 of the second conductor 200 located next thereto. Meanwhile, in the example shown in the drawing, the end of the third conductor 300 forms an open end, and is not connected to the concave portion 204. That is, the third conductor 300 forms an open stub using the concave portion 204 as a return path. Specifically, the second conductor 200 located around the third conductor 300 and the concave portion 204 forms a coplanar line. Meanwhile, in the example shown in FIG. 15, the positions at which the concave portion 204 and the third conductor 300 are formed may be replaced.

Figure 16:
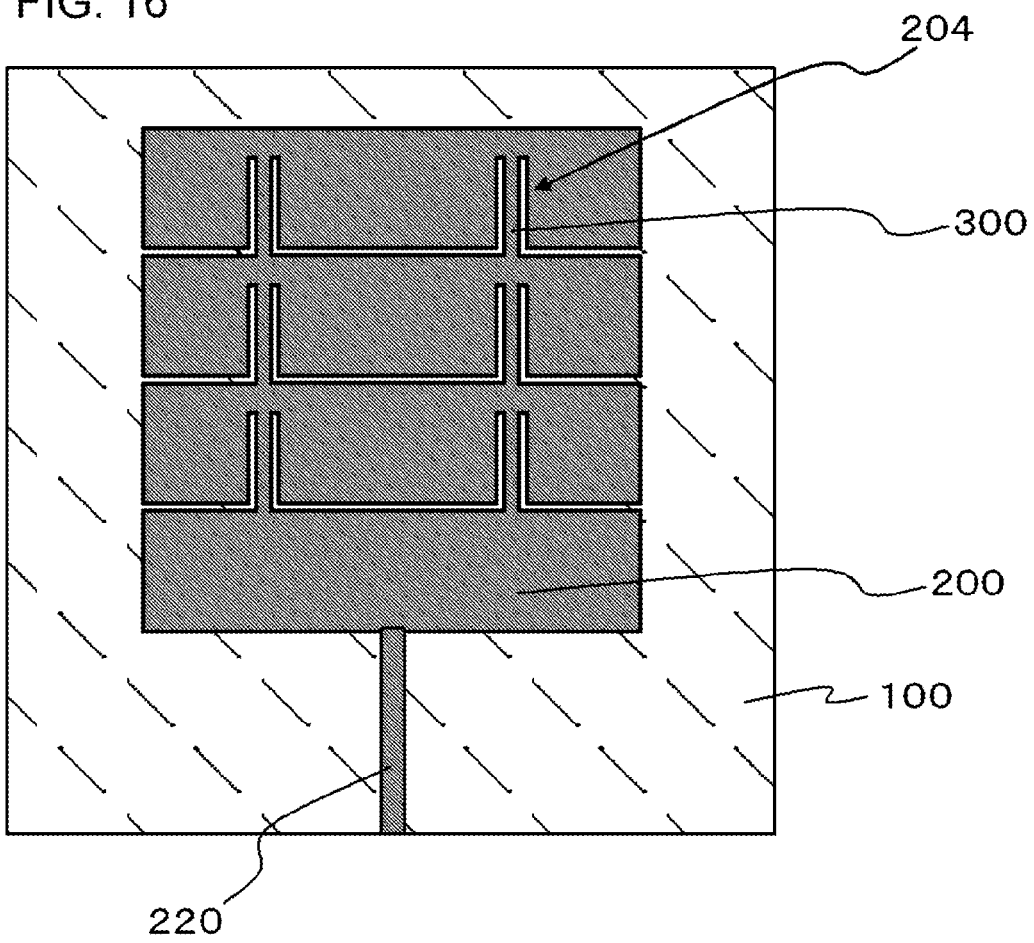
FIG. 16 is a plan view illustrating a modified example of FIG. 15.

FIG. 16 is a plan view illustrating a modified example of FIG. 15. In the example shown in the drawing, the end of the third conductor 300 is connected to the bottom of the concave portion 204. In this case, the third conductor 300 forms a short stub.

In the embodiment, the same effect as that of the second embodiment can also be obtained. In addition, since the third conductor 300 is formed on the same layer as the second conductor 200, the via 500 is not required to be formed, and the number of layers required for the structure can be reduced. Therefore, it is possible to further reduce manufacturing costs of the structure.

Figure 17:
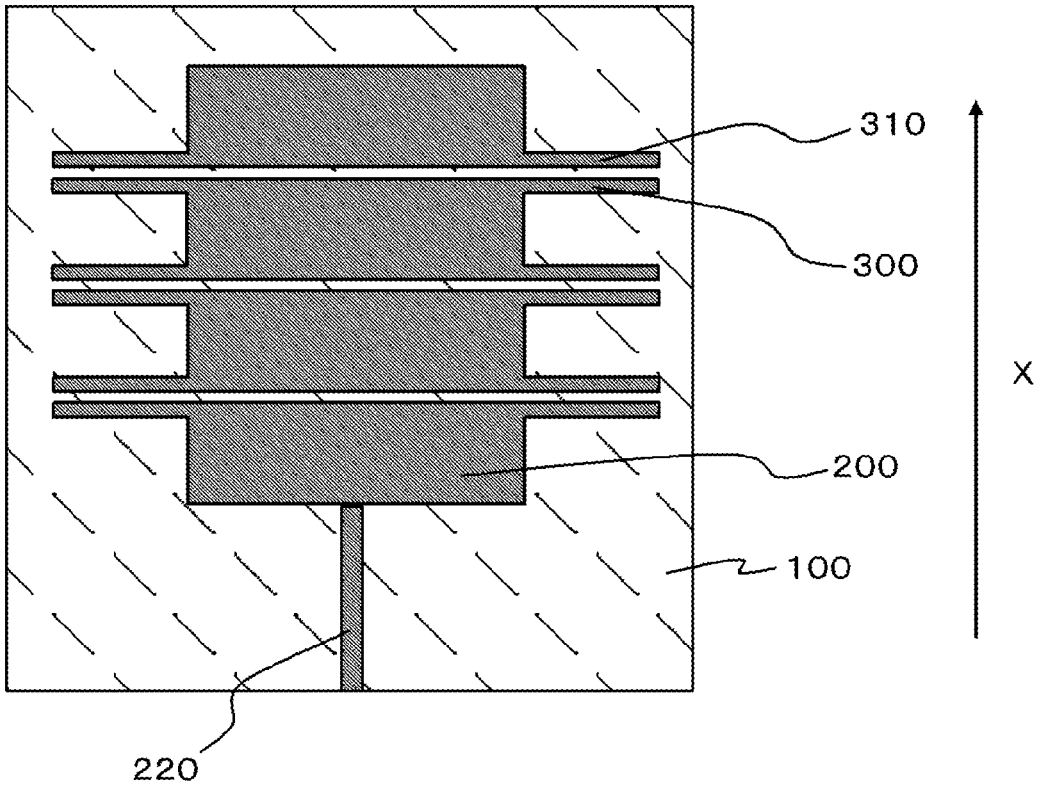
FIG. 17 is a plan view illustrating a configuration of a structure according to an eleventh embodiment.

FIG. 17 is a plan view illustrating a configuration of a structure according to an eleventh embodiment. The embodiment has the same configuration as the structure according to the tenth embodiment, except for the following points.

First, the second conductors 200 do not have the concave portion 204. The second conductors 200 are lined up in the from the side which is opposite to the second one of the second conductors in the first one of the second conductors 200, to the direction intersecting the X direction in the drawing.

Specifically, the second conductor 200 is rectangular in shape. The third conductor 300 is formed integrally with the second conductor 200 at the side which is far from the power feed conductor 220 in the second conductor 200. The third conductor 300 extends in the direction substantially parallel to the above-mentioned side of the second conductor 200, that is, the direction perpendicular to the X direction.

In addition, the second conductor 200 includes a fifth conductor 310 at the side close to the power feed conductor 220. The fifth conductor 310 extends opposite to the third conductor 300 included in the second conductor 200 located next thereto, and a balanced type transmission line is formed by the third conductor 300 and the fifth conductor 310. It is preferable that the third conductor 300 and the fifth conductor 310 are parallel to each other and have the same length. The balanced type transmission line formed by the third conductor and the fifth conductor functions as an open stub. When the wavelength of a signal which is input to the structure is set to $\lambda$, the lengths of the third conductor 300 and the fifth conductor 310 are less than $\lambda/4$ in the case where the structure is used as a left-handed system metamaterial, and are equal to $\lambda/4$ in the case where the structure is caused to operate as the zero-order resonant antenna.

Figure 18:
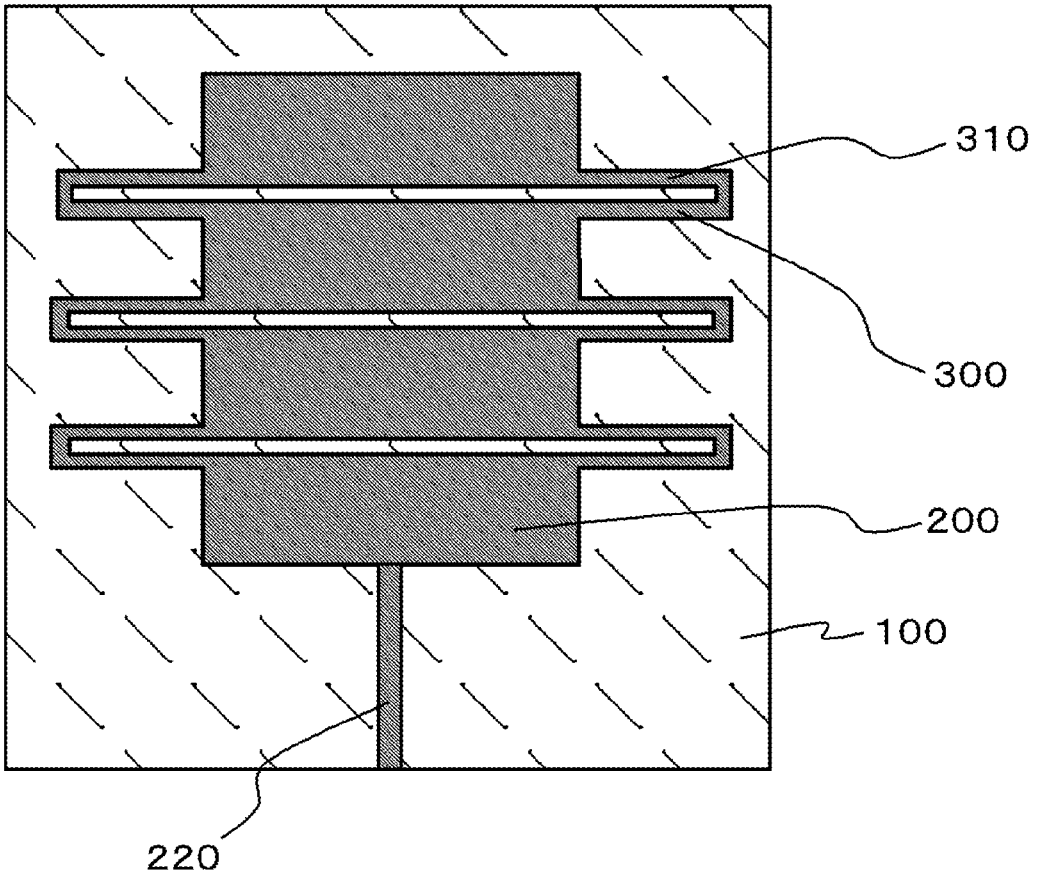
FIG. 18 is a plan view illustrating a modified example of FIG. 17.

FIG. 18 is a plan view illustrating a modified example of FIG. 17. In the example shown in the drawing, the end of the third conductor 300 is connected to the end of the fifth conductor 310. That is, the third conductor 300 forms a short stub together with the fifth conductor 310. When the wavelength of a signal which is input to the structure is set to $\lambda$, the lengths of the third conductor 300 and the fifth conductor 310 are equal to or more than $\lambda/4$ and less than $\lambda/2$ in the case where the structure is used as a left-handed system metamaterial, and are equal to $\lambda/2$ in the case where the structure is made operate as the zero-order resonant antenna.

In the embodiment, the same effect as that of the tenth embodiment can also be obtained.

Figure 19:
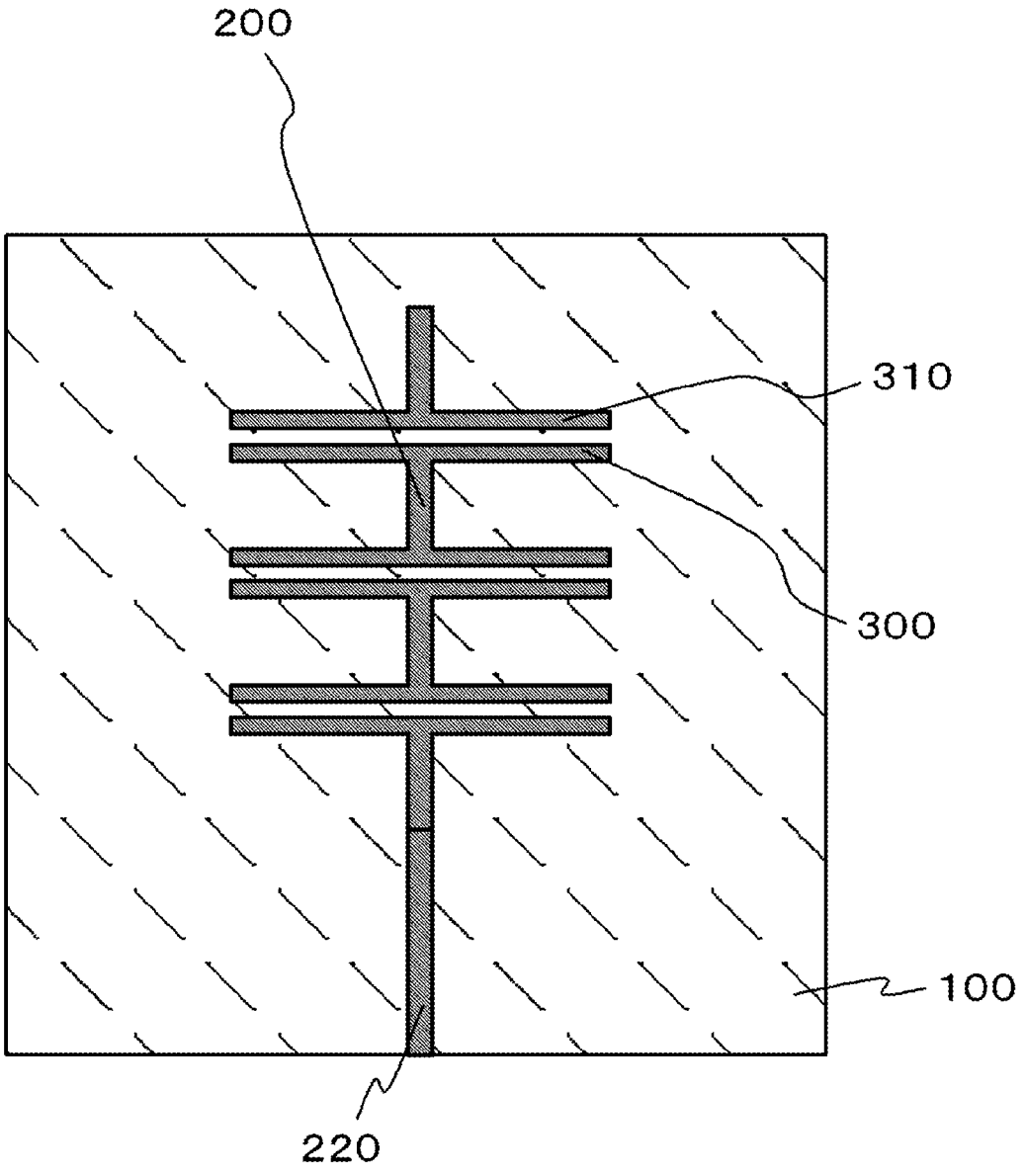
FIG. 19 is a plan view illustrating a configuration of a structure according to a twelfth embodiment.

FIG. 19 is a plan view illustrating a configuration of a structure according to a twelfth embodiment. The structure according to the embodiment has the same configuration as the structure according to the eleventh embodiment, except that the width of the second conductor 200 is nearly the same as the widths of the third conductor 300 and the fifth conductor 310.

Figure 20:
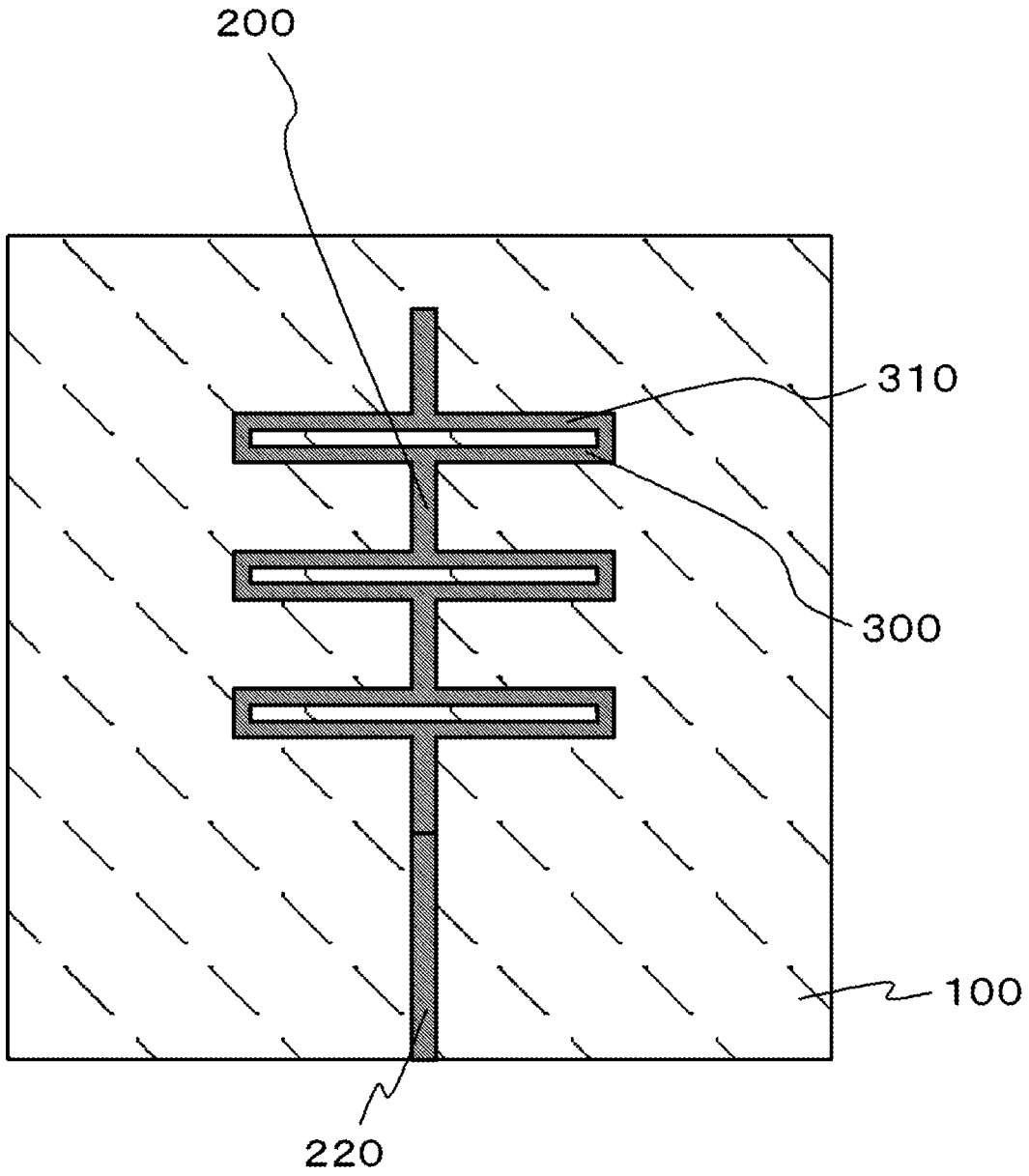
FIG. 20 is a plan view illustrating a modified example of FIG. 19.

FIG. 20 is a plan view illustrating a modified example of FIG. 19. In the example shown in the drawing, the end of the third conductor 300 is connected to the end of the fifth conductor 310. That is, the third conductor 300 forms a short stub together with the fifth conductor 310.

In the embodiment, the same effect as that of the eleventh embodiment can also be obtained.

Figure 21:
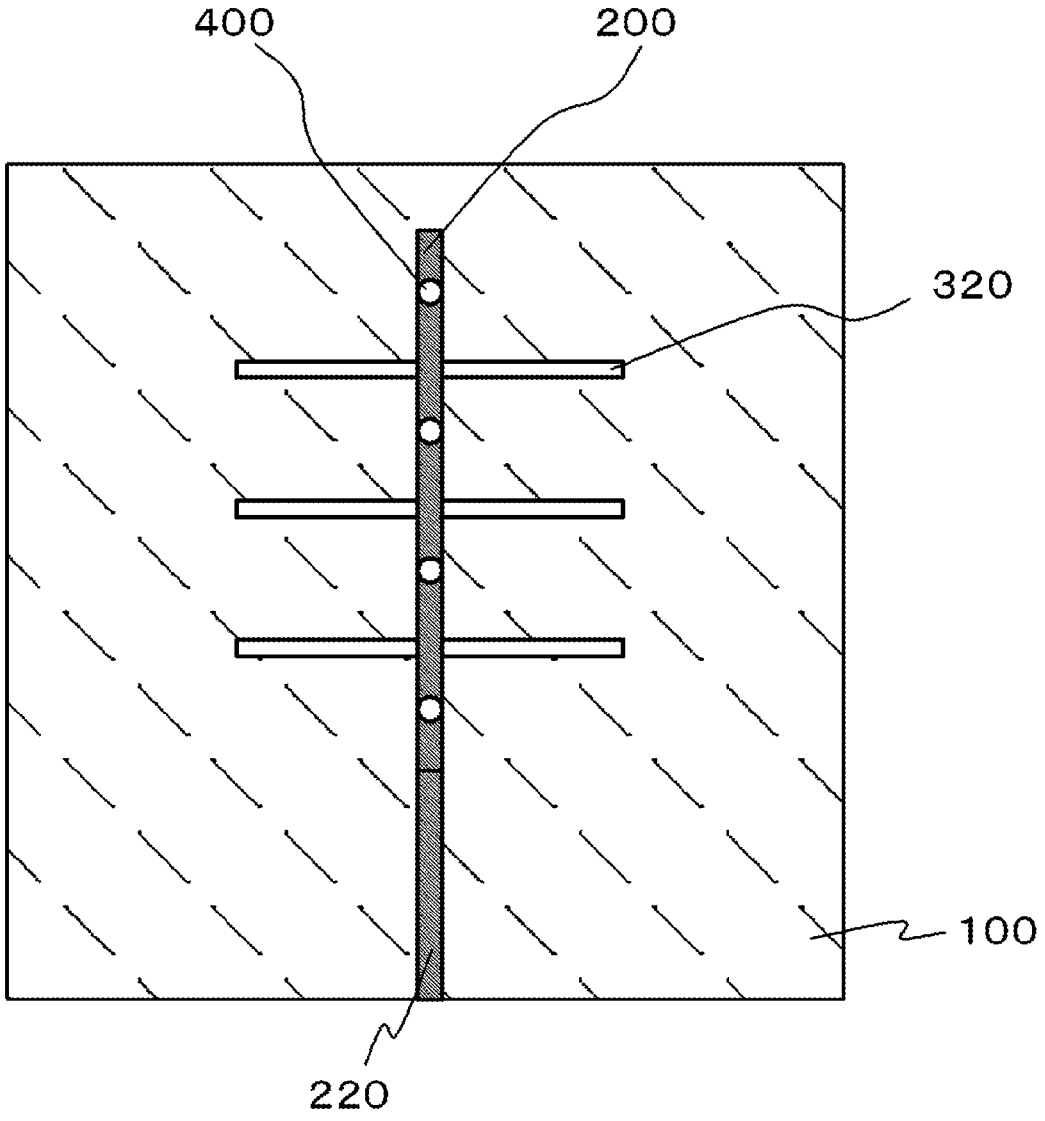
FIG. 21 is a plan view illustrating a configuration of a structure according to a thirteenth embodiment.

FIG. 21 is a plan view illustrating a configuration of a structure according to a thirteenth embodiment. In the drawing, the via 400 is shown for the purpose of the description. This structure includes the first conductor 100, the second conductor 200, and a plurality of slits 320. In the embodiment, the second conductor 200 is linear, and for example, is formed integrally with the power feed conductor 220.

The slit 320 is repeated, for example, periodically provided in the direction intersecting the second conductor 200, for example, the direction perpendicular thereto. In addition, the via 400 is provided between each of the slits 320, and also at the outside of the array of the slits 320.

In such a configuration, the slit 320 forms a slot line together with the first conductor 100. This slot line functions as a short stub. For this reason, in the embodiment, the same effect as that of the first embodiment can also be obtained.

Figure 22:
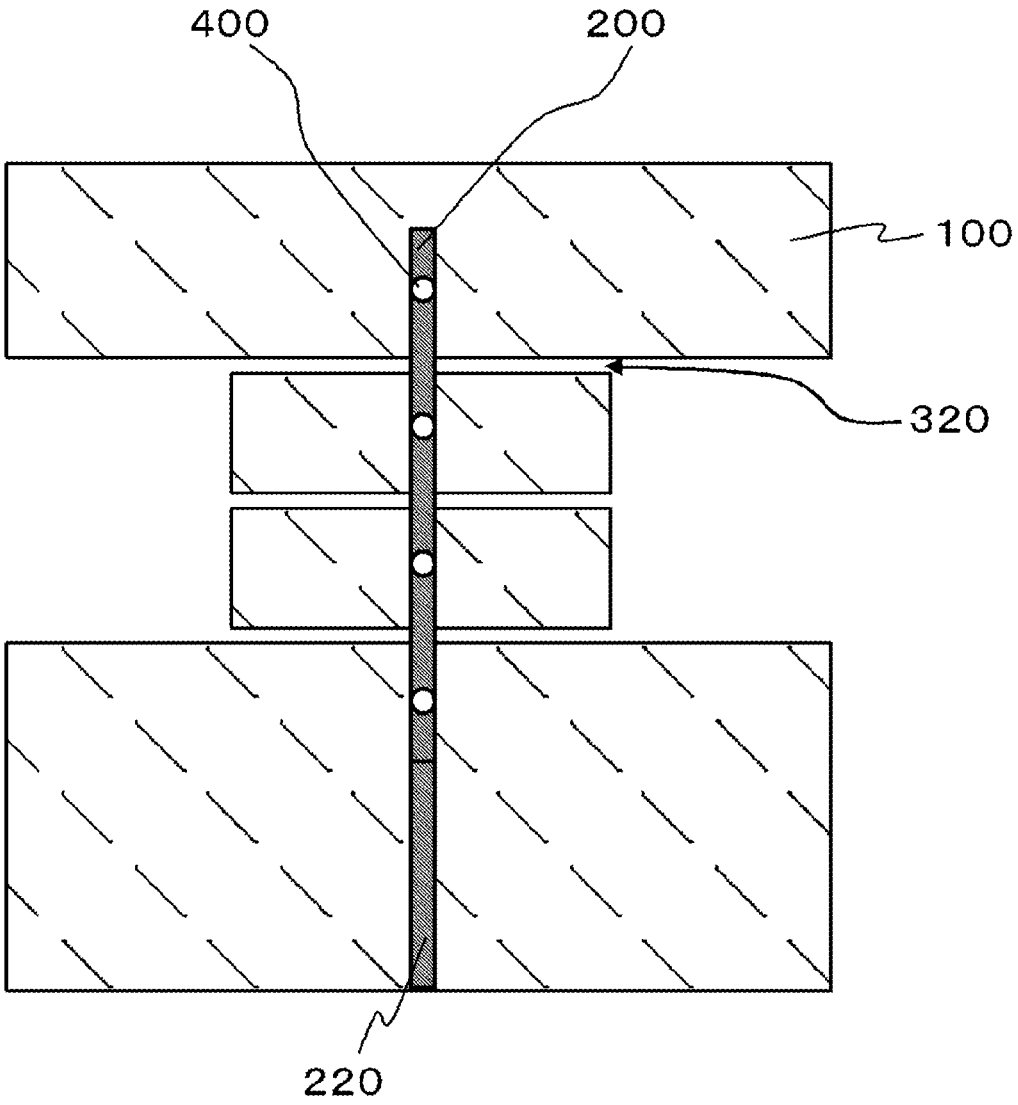
FIG. 22 is a plan view illustrating a configuration of a structure according to a fourteenth embodiment.

FIG. 22 is a plan view illustrating a configuration of a structure according to a fourteenth embodiment. The structure according to the embodiment has the same configuration as the structure according to the twelfth embodiment, except that the first conductor 100 is divided into a plurality of parts.

Specifically, the first conductor 100 is provided one by one for each via 400. A gap is provided in the first conductors 100 located next to each other, and the gap functions as the slit 320.

In such a configuration, the slit 320 forms a slot line together with the first conductor 100. The slot line functions as an open stub. The length of the open stub is as described in the second embodiment. In the embodiment, the same effect as that of the second embodiment can also be obtained.

Figure 23:
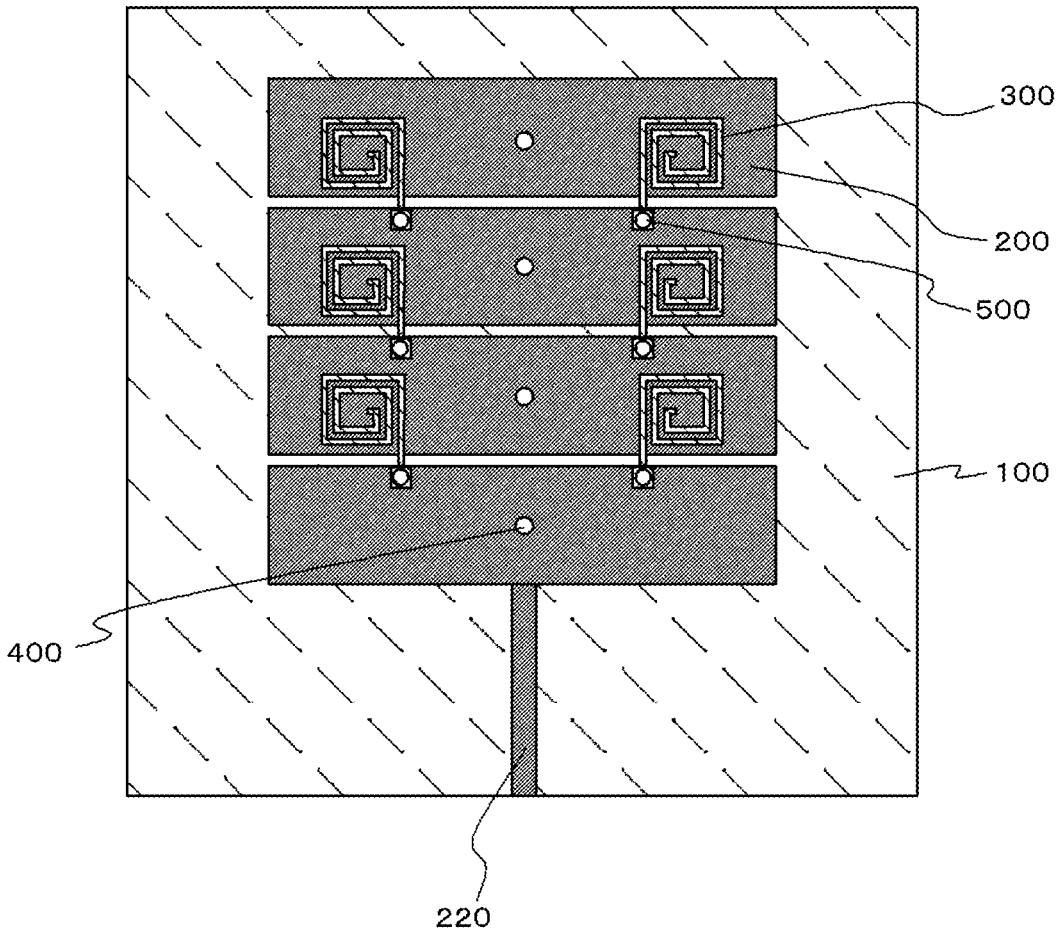
FIG. 23 is a plan view illustrating a modified example of the structure according to the first embodiment.
Figure 24:
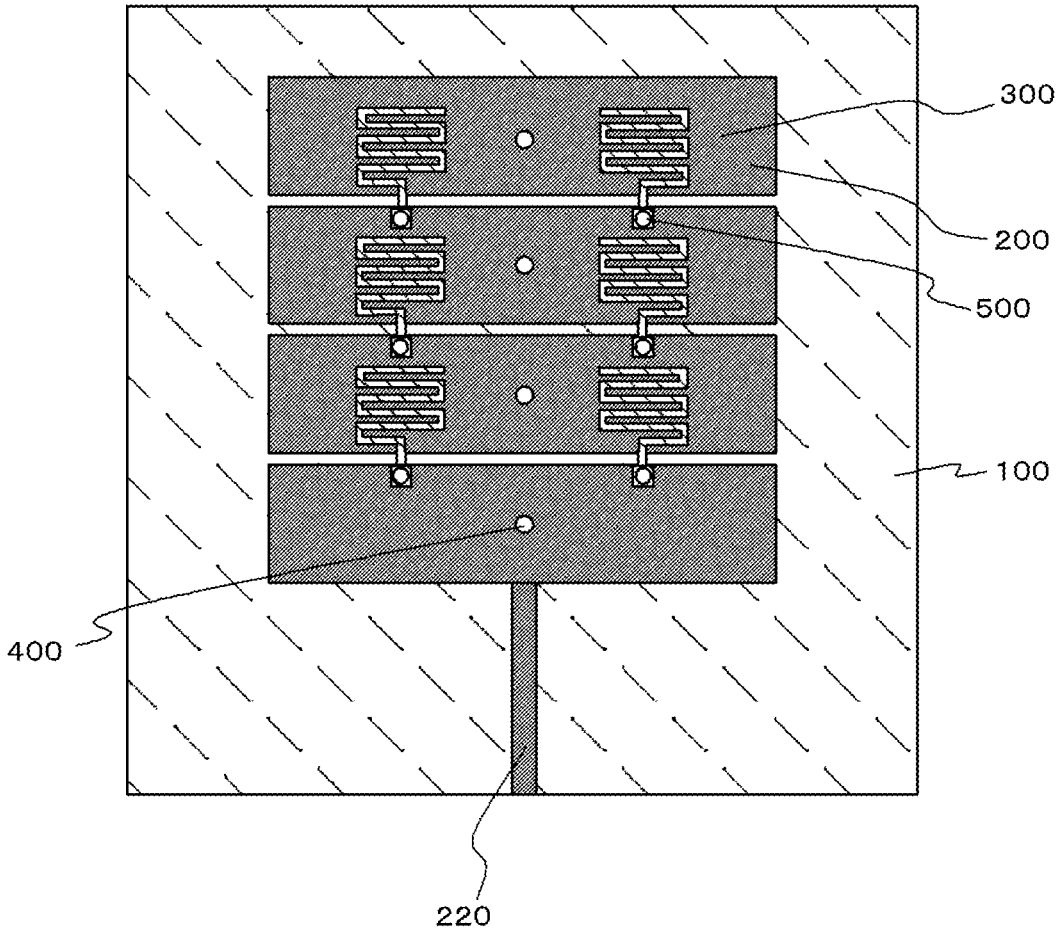
FIG. 24 is a plan view illustrating a modified example of the structure according to the first embodiment.

As described above, although the embodiments of the invention have been set with reference to the drawings, they are merely illustrative of the present invention, and various configurations other than stated above can be adopted. For example, in the first embodiment or the like, the third conductor 300 is not required to extend linearly. For example, the conductor may extend in a spiral shape as shown in FIG. 23, and may extend in a meandering shape, that is, in zigzags as shown in FIG. 24.

The application claims priority from Japanese Patent Application No. 2010-65183 filed on Mar. 19, 2010, the content of which is incorporated herein by reference in its entirety.

The invention claimed is:

1. A structure comprising:

a first conductor;

a first one of a plurality of second conductors, a second one of the second conductors, and a third one of the second conductors opposite to the first conductor, which are arranged in line at a same layer;

an inductance element provided at least one for each of the plurality of second conductors, which provides an inductance component between the first conductor and the second conductor; and a third conductor, electrically connected to the first one of the second conductors, which is spaced from and overlaps with the second one of the second conductors located next to the first one of the second conductors, without the third conductor being electrically connected to the second one of the second conductors.

2. The structure according to claim 1, wherein three or more second conductors are provided, and the third conductor is provided between all of the second conductors located next to each other.

3. The structure according to claim 1, wherein the third conductor is located at the opposite side to the first conductor through the second conductor.

4. The structure according to claim 1, wherein the third conductor is located between the first conductor and the second conductor.

5. The structure according to claim 1, wherein the inductance element includes a via of which one end is connected to the first conductor, and a fourth conductor which is connected to the other end of the via and formed on a layer different from that of the second conductor, and is opposite to the second conductor.

6. The structure according to claim 1, wherein one of the second conductors located at an end of an array of the plurality of second conductors is set as a reference second conductor, and the conductor which is close to the reference second conductor out of the second conductors located next to each other is set as the first one of the second conductors.

7. The structure according to claim 1, wherein the third conductor is formed on the same layer as the second conductor.

8. The structure according to claim 7, wherein the second one of the second conductors includes a concave portion at a side which is opposite to the first one of the second conductors, and the third conductor extends from the first one of the second conductors to an inner side of the concave portion.

9. The structure according to claim 8, wherein the first one of the second conductors and the second one of the second conductors are arranged in a first direction, and the third conductor extends from a side which is opposite to the second one of the second conductors in the first one of the second conductors to a direction intersecting the first direction.

10. The structure according to claim 1, further comprising a power feed line which is connected to the first conductor and the second conductor located at an end of the array of the plurality of second conductors, wherein the structure is at least a portion of an antenna.

11. The structure according to claim 10, wherein the transmission line has an open end, and when a wavelength of a signal which is input to the power feed line is set to $\lambda$, a length of the transmission line is equal to $\lambda/4$.

12. The structure according to claim 1, wherein the third conductor forms a transmission line using the second one of the second conductors as a return path.

13. The structure according to claim 12, wherein the transmission line is a microstrip line.

14. The structure according to claim 12, wherein the transmission line is a coplanar line.

15. The structure according to claim 12, wherein the transmission line is a balanced type transmission line.

16. The structure according to claim 12, wherein the transmission line has an open end.

17. The structure according to claim 16, wherein a signal is input to the first conductor and a plurality of the second conductors, and when a wavelength of the signal is set to $\lambda$, a length of the transmission line is equal to or less than $\lambda/4$.

18. A structure comprising:

a first conductor;

a second conductor, opposite to the first conductor, which is linear;

a plurality of slits that are repeatedly provided in the first conductor and extend in a direction intersecting the second conductor, which has a larger width than that of the second conductor; and an inductance element that provides an inductance component between the first conductor and the second conductor, wherein in a planar view of the structure, a connection part between the inductance element and the first conductor is located between slits, of the plurality of slits, that are adjacent to each other.

19. The structure according to claim 18, wherein the first conductor forms a transmission line in a portion provided with the slit.

20. The structure according to claim 19, wherein the transmission line is a slot line.

* * * * *